US007198259B2

(12) United States Patent
Fritsche

(10) Patent No.: US 7,198,259 B2
(45) Date of Patent: Apr. 3, 2007

(54) METHOD AND APPARATUS FOR CLAMPING A PLURALITY OF OBJECTS TOGETHER

(75) Inventor: David L. Fritsche, Foristell, MO (US)

(73) Assignee: The Boeing Company, Chicago, IL (US)

( * ) Notice: Subject to any disclaimer, the term of this patent is extended or adjusted under 35 U.S.C. 154(b) by 134 days.

(21) Appl. No.: 11/110,259

(22) Filed: Apr. 20, 2005

(65) Prior Publication Data

US 2006/0237887 A1 Oct. 26, 2006

(51) Int. Cl.
*B25B 1/00* (2006.01)

(52) U.S. Cl. ..... 269/21

(58) Field of Classification Search ..... 269/21, 269/71, 75, 296, 291; 294/64.1; 156/381
See application file for complete search history.

(56) References Cited

U.S. PATENT DOCUMENTS 5,395,098 A * 3/1995 Eickhorst et al. ..... 269/21
6,470,942 B1 * 10/2002 Susnjara ..... 156/381
6,502,808 B1 * 1/2003 Stone et al. ..... 269/21
2006/0157905 A1 * 7/2006 Lenzini ..... 269/21
2006/0237887 A1 * 10/2006 Fritsche ..... 269/21

* cited by examiner

*Primary Examiner*—Lee D. Wilson
(74) *Attorney, Agent, or Firm*—Lee & Hayes, PLLC

(57) ABSTRACT

A clamp including a vacuum base having a seal adapted to engage a first object. A cavity is defined between the first object and the seal. The clamp includes a vacuum generator connected to the cavity for reducing pressure in the cavity and a clamping member mounted on the vacuum base for engaging a second object. The clamp further includes a valve connected between the cavity and the vacuum generator. The valve is selectably positionable between an open position allowing fluid communication between the vacuum generator and the cavity for generating a pressure inside the cavity that is lower than a pressure outside the cavity, and a closed position at least partially restricting fluid communication between the vacuum generator and the cavity for at least partially preventing air from entering the cavity when pressure inside the cavity reaches a predetermined maximum.

15 Claims, 7 Drawing Sheets

METHOD AND APPARATUS FOR CLAMPING A PLURALITY OF OBJECTS TOGETHER

BACKGROUND OF THE INVENTION

The present invention relates generally to clamping a plurality of objects together, and more specifically to a clamp adapted to prevent inadvertently detaching a clamp from an object.

Objects may often be clamped together to facilitate working with the objects. For example, during assembly and/or maintenance objects may often by clamped together for drilling, fastening, and/or sealing. Although C-clamps are sometimes used to clamp parts together, c-clamps may not always be very useful, particularly when assembling large objects. Spring loaded clamps and/or screw operated wedge-locks can also be used to clamp objects together, and are particularly useful when clamping large objects. However, these clamps require holes to be drilled in an object, which may not be appropriate and/or convenient. Further, drilling holes may increase assembly time and cost.

SUMMARY OF THE INVENTION

In one aspect, the present invention includes a clamp for clamping a plurality of objects together. The clamp comprises a vacuum base having a seal adapted to engage a first object of the plurality of objects. A cavity is defined between the first object and the seal when the seal is engaged with the first object. The clamp also includes a vacuum generator fluidly connected to the cavity for reducing a pressure in the cavity so the pressure inside the cavity is lower than a pressure outside the cavity thereby to attach the vacuum base to the first object. In addition, the clamp includes a clamping member mounted on the vacuum base for engaging a second object of the plurality of objects. The clamping member is movable with respect to the vacuum base for applying a force to the second object to clamp the second object in position relative to the first object when the vacuum base is attached to the first object. The clamp also includes a valve fluidly connected between the cavity and the vacuum generator. The valve is selectably positionable between an open position allowing fluid communication between the vacuum generator and the cavity for generating a pressure inside the cavity that is lower than a pressure outside the cavity, and a closed position at least partially restricting fluid communication between the vacuum generator and the cavity for at least partially preventing air from entering the cavity when pressure inside the cavity reaches a predetermined maximum.

In another aspect, the present invention includes a method for preventing a clamp from being detached from an object. The clamp includes a seal adapted to engage the object and define a cavity between the object and the seal, a vacuum generator fluidly connected to the cavity and a fluid source for generating a pressure inside the cavity that is lower than a pressure outside the cavity, and a valve fluidly connected between the vacuum generator and the fluid source. The method comprises allowing fluid communication between the vacuum generator and the cavity when the fluid flow received by the vacuum generator is above a predetermined flowrate, and at least partially preventing fluid from entering the cavity when the fluid flow received by the vacuum generator falls below a predetermined flowrate.

Other features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
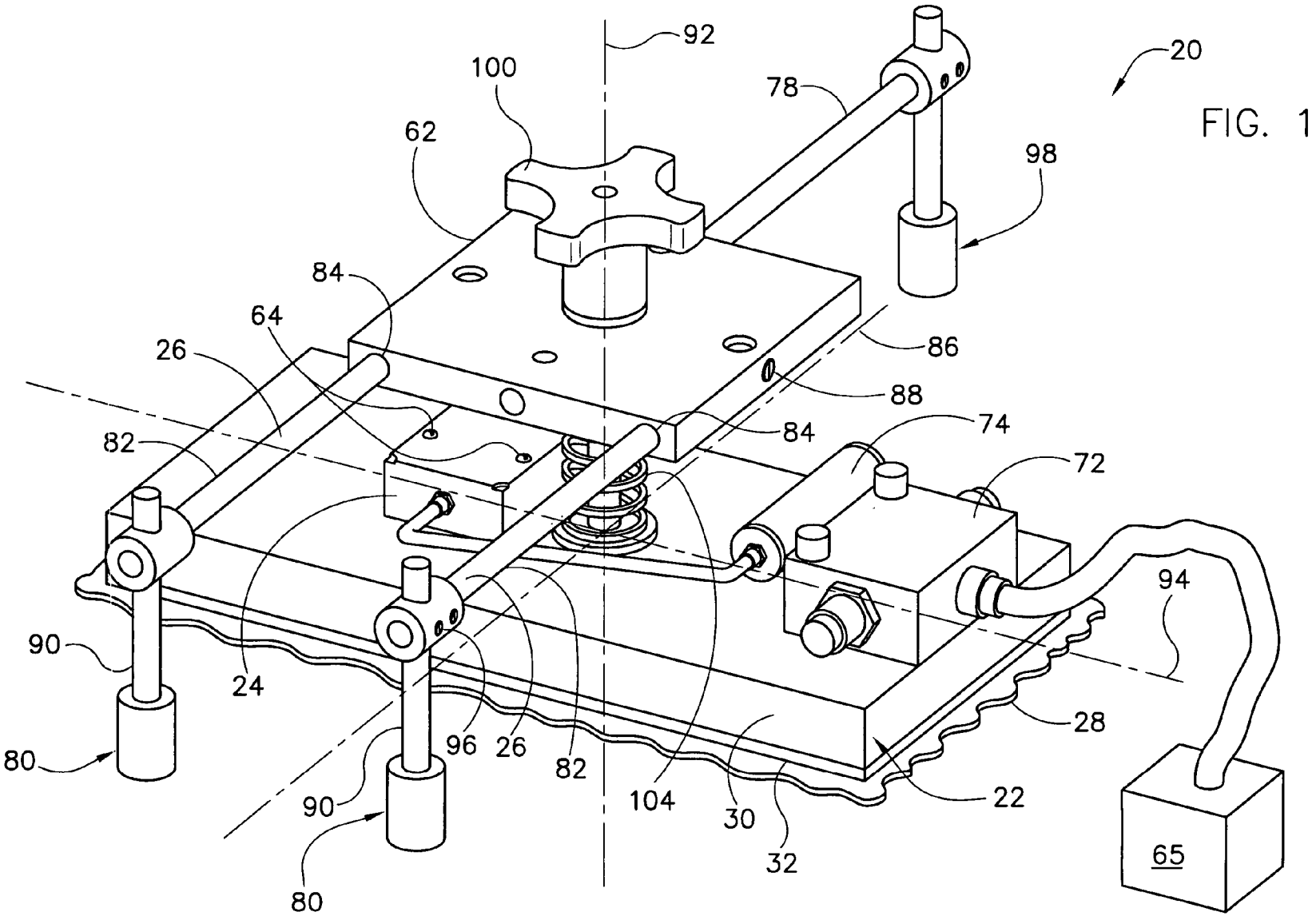
FIG. 1 is a perspective of a clamp of the present invention for clamping a plurality of objects together.
Figure 2:
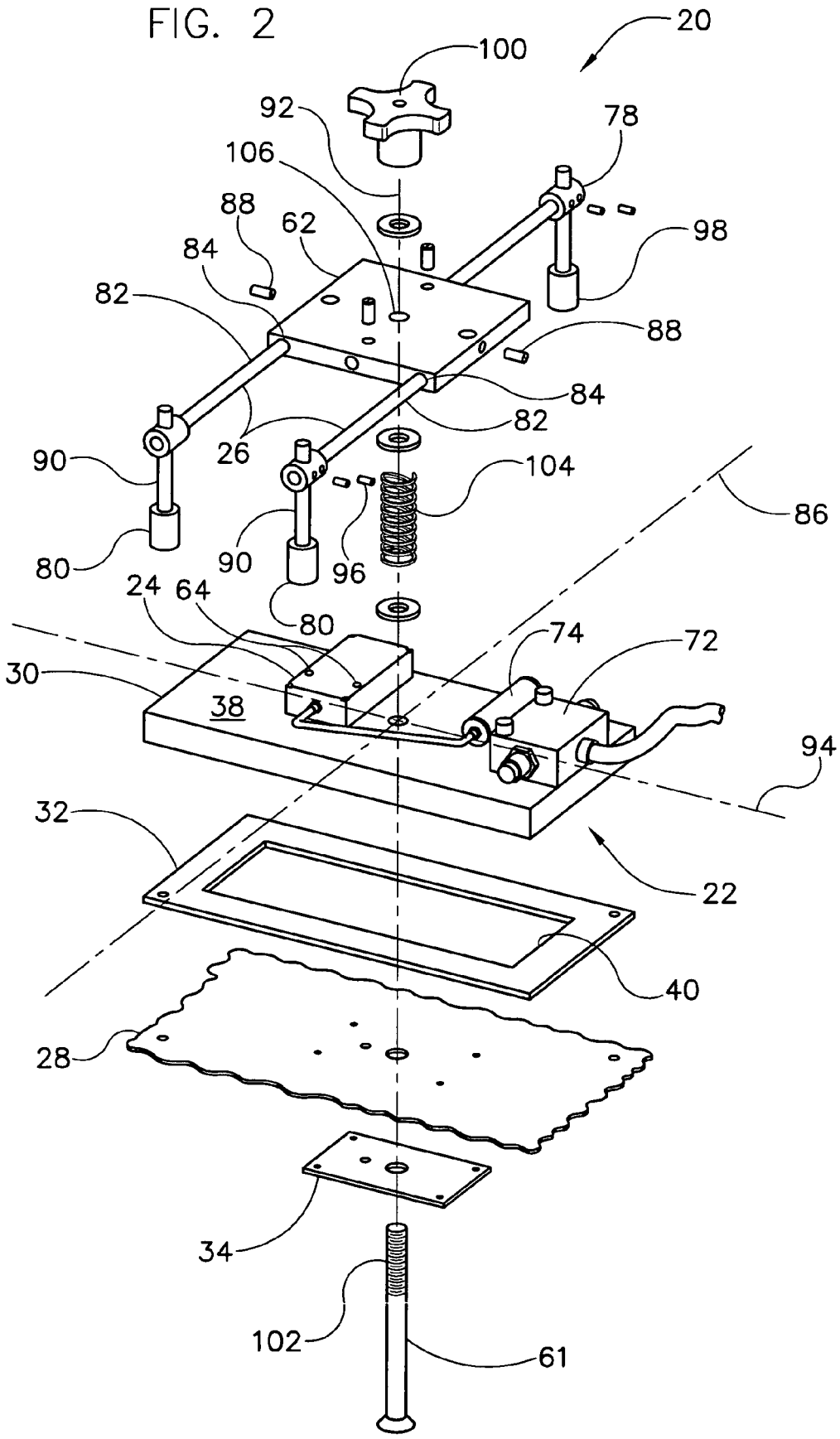
FIG. 2 is an separated perspective of the clamp shown in FIG. 1.

Referring now to the drawings, and more specifically to FIGS. 1 and 2, a clamp is designated in its entirety by the reference numeral 20. Generally, the clamp 20 includes a vacuum base (generally designated by 22) for attaching the clamp to a first object (not shown in FIGS. 1 and 2), a vacuum generator 24 for creating a negative pressure differential (i.e., a suction) to attach the vacuum base to the object (as is described below in more detail), and a clamping member 26 for engaging a second object (not shown in FIGS. 1 and 2) to clamp the two objects together.

To avoid confusion, the objects described herein will often be referred to as a first object and a second object. However, the clamps described and illustrated herein are not limited to clamping only two objects together, but rather may clamp any number of objects together without departing from the scope of the present invention. Furthermore, the vacuum bases 22 of the clamps 20 described and illustrated herein may attach to any of the objects being clamped together, whether such objects are referred to as a first, second, or other object. Moreover, in an alternative embodiment not illustrated herein, the vacuum bases 22 of the clamps 20 may attach simultaneously to more than one object.

Figure 3:
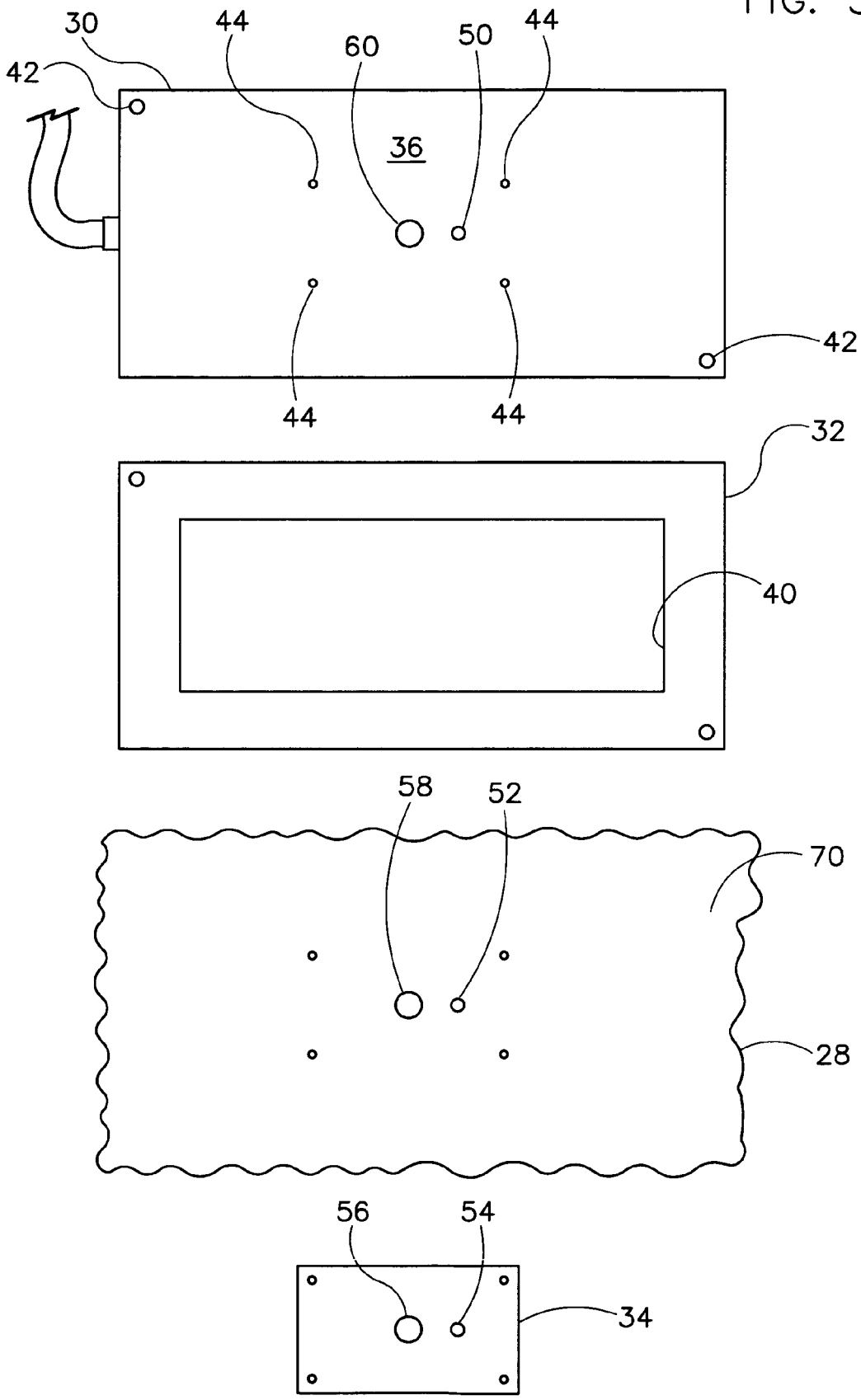
FIG. 3 is an separated top plan of a base plate, a frame, a seal, and a seal support plate of the clamp shown in FIG. 1.
Figure 4:
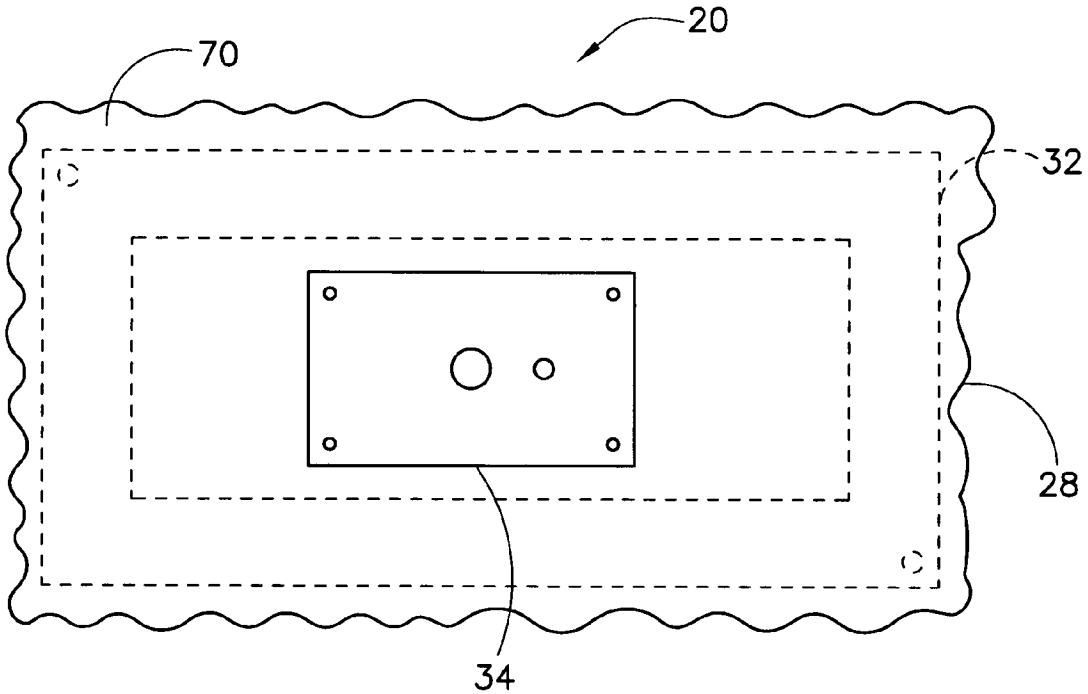
FIG. 4 is a top plan of the clamp shown in FIG. 1 illustrating the frame, the seal, and the seal support plate mounted on the base plate.
Figure 6:
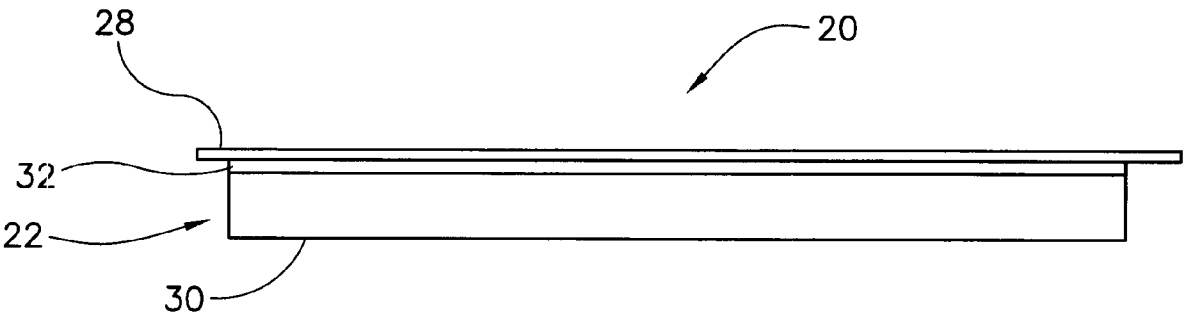
FIG. 6 is a side elevation of a portion of the clamp shown in FIG. 1.

To facilitate attaching the clamp 20 to a first object, the vacuum base 22 includes a seal 28 adapted to engage the first object (not shown in FIGS. 1 and 2). More specifically, as shown in FIGS. 2 and 3, the vacuum base 22 includes a base plate 30, a frame 32, the seal 28, and a seal support plate 34. Although the seals may comprise other materials without departing from the scope of the present invention (e.g., Ethafoam polyethylene foam available from Dow Chemical Company of Midland, Mich.), in one embodiment the seal 28 comprises neoprene. As shown in FIGS. 1 and 2 and described in more detail below, the clamping member 26 and the vacuum generator 24 are mounted on the base plate 30. The base plate 30 has a first surface 36, shown in FIG. 3, and a second surface 38 opposite the first surface shown in FIGS. 1 and 2. As shown in FIG. 2, the frame 32 is mounted on the first surface 36, and the seal 28 is positioned on the first surface within an opening 40 of the frame 32. The seal support plate 34 is then mounted on the base plate 30 over the seal 28 to secure the seal to the base plate 30. FIG. 4 and 6 illustrate the frame 32, the seal 28, and the seal support plate 34 (FIG. 4) mounted on the base plate 30 (FIG. 6) in an assembled clamp 20. Although any suitable attachment may be used without departing from the scope of the present invention, as shown in FIG. 3 in one embodiment the base plate 30 includes a plurality of threaded openings 42, 44 for receiving a plurality of threaded fasteners 46, 48 (shown in FIG. 2) to securely attach the frame 32 and the seal support plate 34 to the base plate 30.

Each of the base plate 30, the seal 28, and the seal support plate 34 has an opening 50, 52, 54, respectively, for fluidly communicating with a cavity (not shown in FIG. 3) defined between the first object and the seal 28 when the seal engages the first object, as will be described in more detail below with regard to the vacuum generator 24. Additionally, each of the seal support plate 34, the seal 28, and the base plate 30 include an opening 56, 58, 60, respectively, for receiving a threaded faster 61 (shown in FIG. 2) on the clamp 20 to mount a clamping block 62 (shown in FIGS. 1, 2, and 5), as will be described in more detail below.

Figure 5:
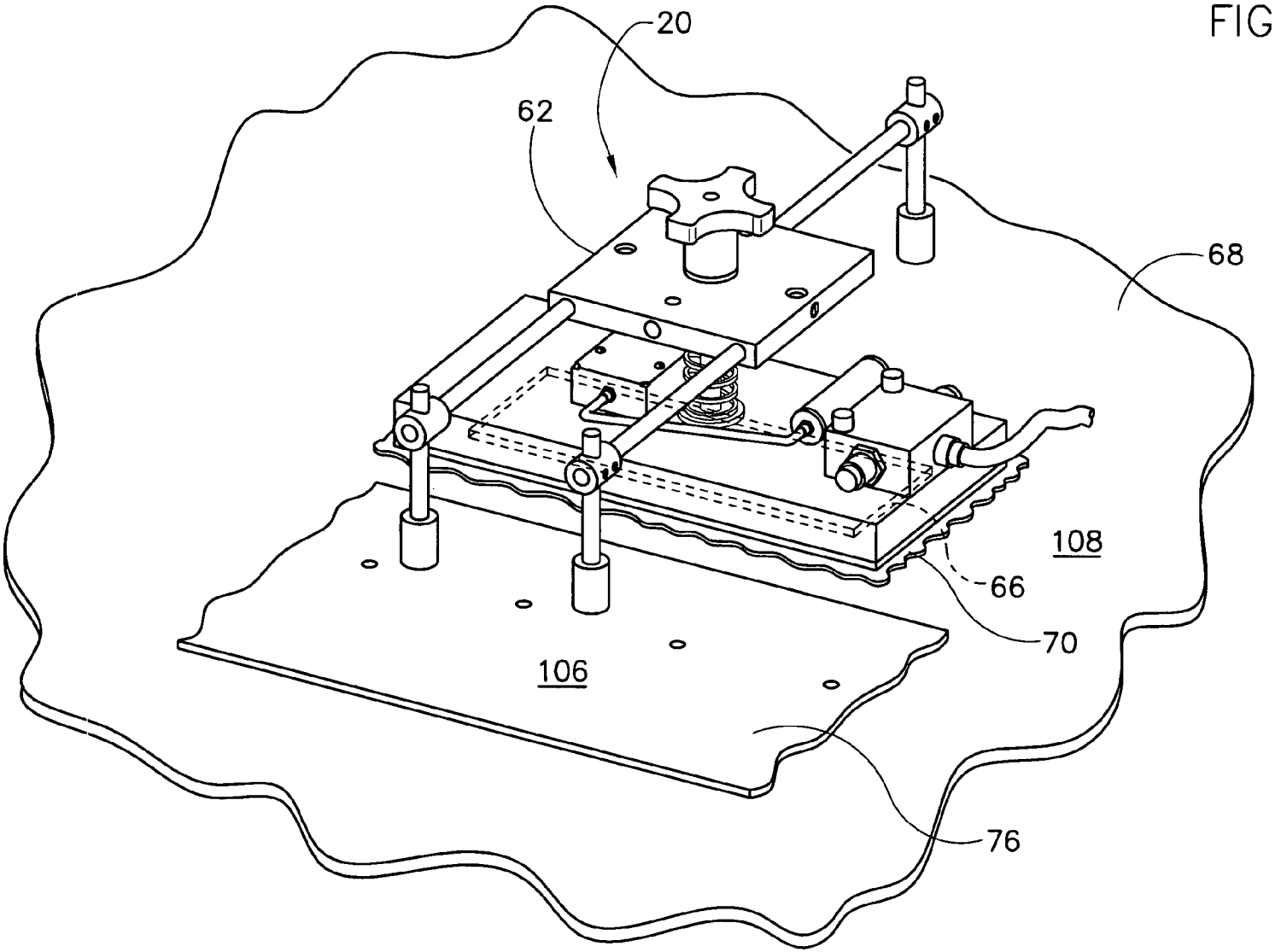
FIG. 5 is a perspective illustrating the clamp shown in FIG. 1 attached to an object and clamping the object to another object.

As shown in FIGS. 1 and 2, the vacuum generator 24 is mounted on the second surface 38 of the base plate 30. Although any suitable attachment may be used without departing from the scope of the present invention, in one embodiment the vacuum generator 24 is mounted on the base plate 30 using a plurality of threaded fasteners 64. Generally, to attach the seal 28, and therefore the clamp 20 to the first object, the vacuum generator 24 generates a suction in the cavity (not shown) defined between the seal and the first object so a pressure within the cavity is lower than a pressure outside the cavity. The vacuum generator 24 creates the suction using a fluid flow such as a flow of air from an air source 65. The vacuum generator 24 is fluidly connected to a source of air 65 and, in one embodiment, includes a venturi (not shown) for generating the suction. In one embodiment, the air source 65 is a source of compressed air. Further, in one embodiment the venturi is a multi-stage venturi. Specifically, when the frame 32, the seal 28, and the seal support plate 34 are mounted on the base plate 30, the openings 50, 52, 54 are generally aligned so they are in fluid communication with each other. An opening (not shown) in the vacuum generator 24 fluidly communicates with the openings 50, 52, 54, the venturi, and the cavity defined between the seal and the first object. As shown in FIG. 5, the cavity (generally designated by the reference numeral 66 in FIG. 5) defined between the seal 28 and the first object (generally designated by the reference numeral 68 in FIG. 5) is formed when the seal 28 engages the first object, and more specifically an outer perimeter, generally designated by 70, of the seal (shown more clearly in FIGS. 3 and 4) completely engages the first object.

When the seal 28 engages the first object 68, the venturi may be operated to generate a suction in the cavity 66 by directing air received from the air source to flow through the venturi. As the air flows through the venturi, it experiences a drop in pressure within a section (not shown) of the venturi fluidly connected to the cavity by the openings opening 50, 52, 54 and the opening within the vacuum generator 24 thereby reducing a pressure within the cavity 66. Of course, other types of vacuum generators 24 that use a flow of air to generate a suction may be used without departing from the scope of the present invention. When the pressure within the cavity 66 is lower than an ambient pressure outside the cavity (e.g., an area generally around the clamp), the seal 28, and thus the base plate 30, will be drawn against the first object. If the pressure difference is sufficiently large, the base plate 30 will be attached to the first object. Depending upon the orientation of the clamp 20 and the first object, the pressure differential between the cavity 66 and area outside the cavity may need to be large enough to support the weight of the clamp. In one embodiment, the vacuum generator 24 generates a suction requiring a separation force of between about 100 and about 150 pounds to be applied to the clamp in a direction generally perpendicular to the base plate 30 to overcome the suction and separate the clamp from the object.

Under some conditions, the vacuum generator 24 may generate a large enough suction within the cavity such that a vacuum is formed within the cavity. In such cases, the cavity may collapse such that all or a portion of the seal 28 and/or seal support plate 34 may contact the first object. In some cases, the cavity 66 may completely collapse. It should be understood that even when the cavity 66 is completely collapsed it may still be referred to herein as a cavity.

Although other specific vacuum generators may be used without departing from the scope of the present invention, in one embodiment the vacuum generator 24 is a Model X10 available from Piab USA Inc. of Hingham, Mass.

The clamp 20, and more specifically the seal 28 described herein is not intended to be limited to use with objects having generally flat attachment surfaces, but rather may be used with contoured objects without departing from the scope of the present invention. For example, as shown in FIG. 6 the seal 28 may be shaped to engage one more contoured surfaces (not shown). Additionally, as the vacuum generator 24 reduces the pressure within the cavity 66 (FIG. 5), the frame 32 may curl the outer perimeter 70 of the seal 28 around the contoured surface to form the cavity.

As shown in FIGS. 1 and 2, in some embodiments the clamp 20 may include a control valve 72 fluidly connected between the air source and the vacuum generator 24 for controlling the flow of air supplied to the vacuum generator. Although other control valves may be used without departing from the scope of the present invention, in one embodiment the control valve 72 is a Model MJV-4D available from Clippard Instrument Laboratory, Inc. of Cincinnati, Ohio. Further, in one embodiment the clamp 20 may include an output 74 fluidly connected between the air source 65 and the vacuum generator 24 for delivering air from the air source to another clamp adjacent the clamp 20 to facilitate using a plurality of clamps to clamp objects together.

The clamping member 26 is mounted on the base plate 30 via the clamping block 62. Specifically, the clamping block 62 is mounted on the base plate 30 using the threaded fastener 61. Generally, the claming member 26 is mounted on the clamping block 62 and is movable with respect to the base plate 30 for applying a force to a second object (generally designated by the reference numeral 76 in FIG. 5) to clamp the first object 68 (FIG. 5) and the second object together. As shown herein, the clamp 20 includes a plurality of clamping members 26 for engaging the second object, for example three, and a single clamping member 78 for engaging the first object to support, or balance, the clamp. The clamp 20 may include any number of clamping members 26, 78 without departing from the scope of the present invention. Specifically, the clamping members 26 may be movable with respect to the clamping block 62 to position an end (generally designated by 80) of each of the clamping members 26 into engagement with the second object. Although this movement may be accomplished using any suitable means, and additionally the clamping members 26 may be mounted on the block 62 in any suitable fashion without departing from the scope of the present invention, in the embodiments shown herein the clamping members 26 each include an extension 82 extending from the clamping block. Each extension 82 is received within an opening 84 in the clamping block. The extensions 82 are movable within the openings 84 such that they can be moved with respect to the block 62 generally along an axis (e.g., axis 86) extending through the block. Once positioned as desired, the extensions 82 may be secured in place using a set screw 88 and/or any other suitable means. In addition, the members 26 each include a second extension 90 extending outward from the respective first extension 82. The second extensions 90 are movable with respect to the first extensions 82 and the clamping block along an axis (e.g., central axis 92) extending generally non-parallel to an axis (e.g., longitudinal axis 94) extending through a length of the vacuum base 22. Once positioned as desired, the extensions 92 may be secured in place using a set screw 96 and/or any other suitable means.

Similarly to the clamping members 26, the clamping members 78 may be movable and securable with respect to the clamping block 62 to position and hold an end (generally designated by 98) of the clamping members 78 in engagement with the first object. Although this moving and securing may be accomplished using any suitable means, and additionally the clamping members 78 may be mounted on the block 62 in any suitable fashion without departing from the scope of the present invention, in one embodiment the clamping members 78 are generally mounted, movable, and securable in a similar fashion as the clamping members 26. Accordingly, the specific mounting, moving, and securing of the clamping members 78 will not be described in more detail herein.

The clamping members 26, 78 are also movable along an axis (e.g., the central axis 92) extending through the clamp 20 the is generally non-parallel with an axis (e.g., the longitudinal axis 94) extending through a length of the vacuum base 22. Although this movement may be accomplished using any suitable means, and the clamping block 62 may be mounted on the vacuum base 30 in any suitable fashion without departing from the scope of the present invention, in one embodiment the threaded fastener 61 is received in a central opening 96 of the clamping block. A turning knob 100 having a threaded hole (not shown) receives a threaded end (shown in FIG. 2 and designated by 102) of the fastener 61 to secure the clamping block 62 to the vacuum base 22. A biasing mechanism 104 (e.g., a spring) is positioned on the fastener 61 between the base plate 30 and the clamping block 62 to bias the clamping block toward the threaded end 102 and the knob 100.

In operation, the vacuum base 22 is attached to the first object and each of the clamping members 26, 78 are moved with respect to the clamping block 62 to press their ends 80, 98 against the second and first objects, respectively. The knob 100 can then be turned to move the clamping block 62 and the ends 80, 98 of the members 26, 78 against the bias of the spring along an axis (e.g., the central axis 92) extending through a length of the clamp 20 to apply force to the second object to clamp the first and second object together. FIG. 5 illustrates the first and second objects 68, 76, respectively, clamped together as discussed above. In one embodiment, the opening 106 (FIG. 2) in the clamping block 62 for receiving the fastener 61 has a diameter larger than a diameter of the fastener to allow the clamping block 62 and therefore the members 26, 78 to pivot with respect to the vacuum base 22 to facilitate clamping objects having non-parallel surfaces, clamping objects that are not generally planar, and/or moving the clamp from one object to another without adjusting the members 26, 78.

Although the clamp 20 is shown as generally clamping two objects together by applying force generally perpendicular to the vacuum base 22 and a surface 108 (FIG. 5) of the first and second objects 68, 76 (e.g., along the central axis 92), the ends 80, 98 of the respective members 26, 78 may apply a force in any general direction with respect to the vacuum base 22 and/or any surfaces of any object without departing from the scope of the present invention.

Because the vacuum generator 24 uses a flow of air to generate the pressure differential that attaches the clamp 20 to the first object 68, if for any reason the flow of air received by the vacuum generator 24 falls below a predetermined flowrate, the pressure within the cavity 66 may rise to a level such that the difference in pressure between the air inside the cavity and ambient air outside the cavity may not be great enough to keep the clamp attached to the first object. For example, if the vacuum generator 24 uses a venturi as described above, air may leak into the cavity 66 through exhaust ports (not shown) of the venturi and equalize the pressure inside and outside the cavity if the flow of air to the venturi is interrupted. Consequently, the clamp 20 may become detached from the first object 68 and the other objects or the clamp itself may fall or move, possibly causing damage to the clamp and/or objects.

Figure 7:
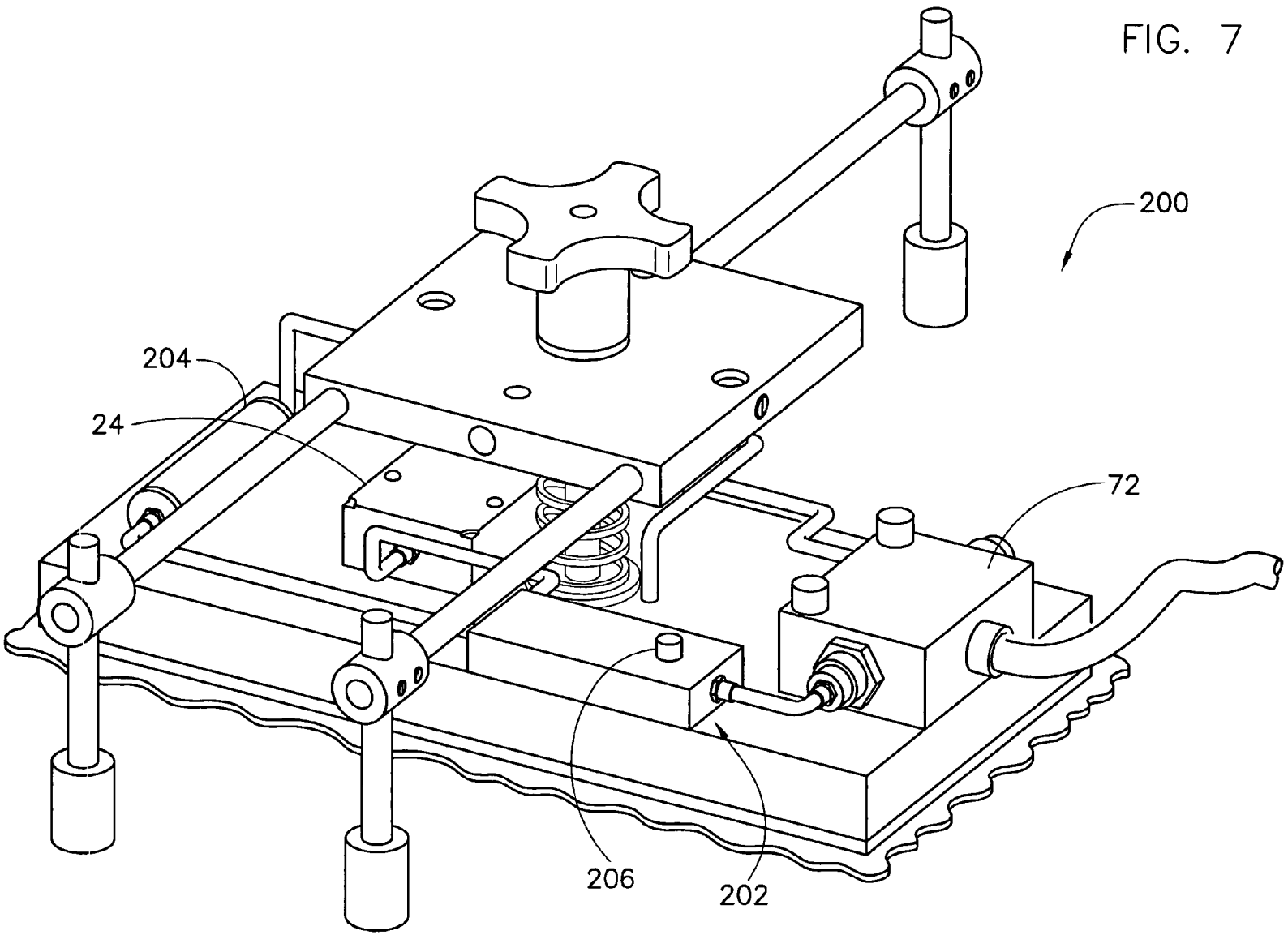
FIG. 7 is a perspective of a clamp of the present invention including a back-up valve.
Figure 8:
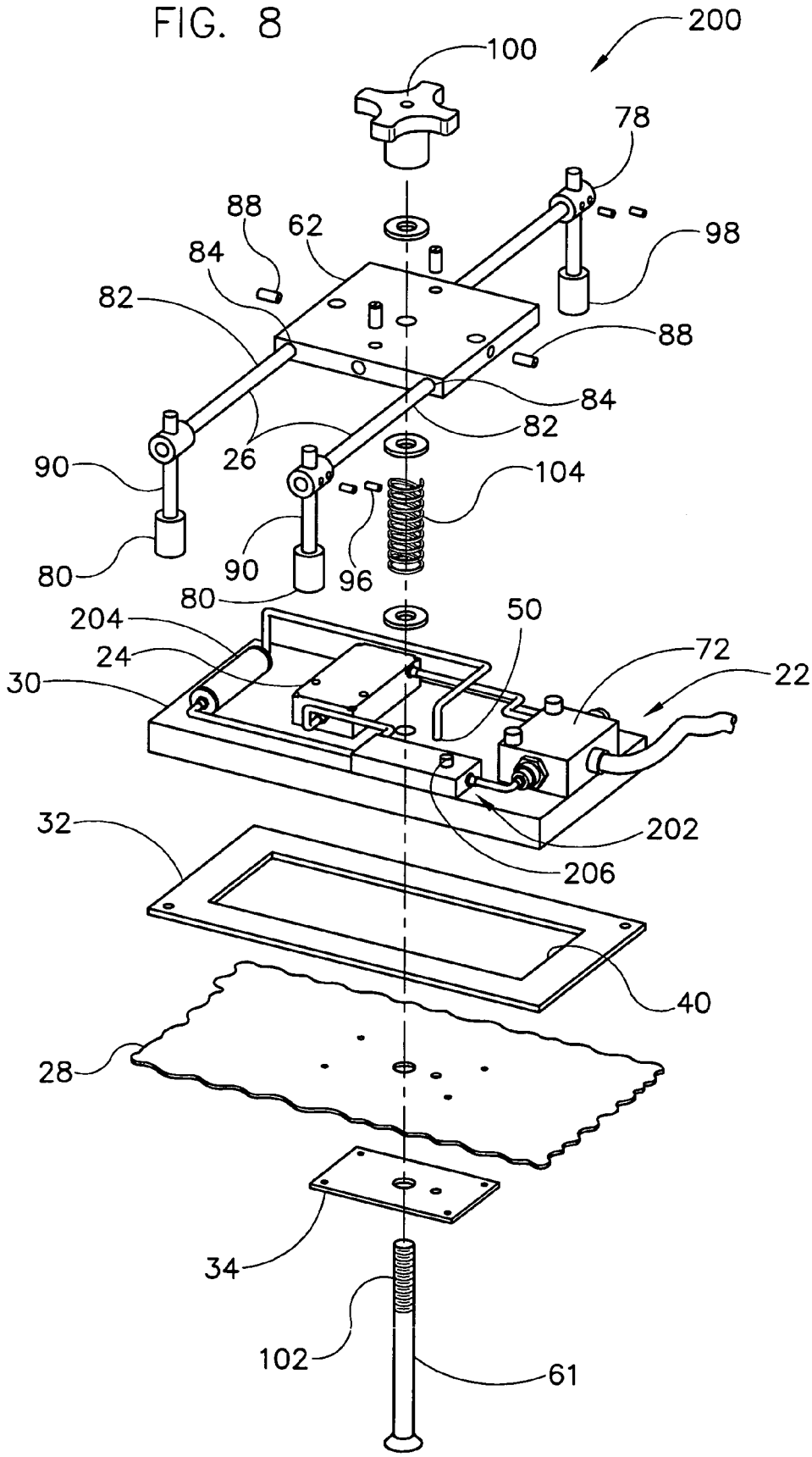
FIG. 8 is a separated perspective of the clamp shown in FIG. 7.

As shown in FIGS. 7 and 8, a clamp 200 of the present invention includes a back-up valve (generally designated by 202) adapted to facilitate preventing detachment of the clamp from an object (e.g., the first object 68) in the event that the air flow supplied to the vacuum generator falls below a minimum operational flowrate. The clamp 200 is similar to the clamp 20 described above, but also includes the back-up valve 202. Generally, the back-up valve 202 is selectable between an open position (not shown) and a closed position (not shown). The open position allows fluid communication between the vacuum generator 24 and the cavity 66 (FIG. 5) so the vacuum generator can generate the pressure differential to attach the clamp to the first object 68. The closed position at least partially restricts fluid communication between the vacuum generator 24 and the cavity 66 to at least partially prevent air from entering the cavity (e.g., through venturi exhaust ports) when the air flow to the vacuum generator falls below a minimum operational flowrate.

Although other valves may be used without departing from the scope of the present invention, in one embodiment the back-up valve 202 is a Model D20SMKO valve available from Dynamco, Inc. of McKinney, Tex.

Although the back-up valve 202 may be adapted to prevent detachment of the clamp 200 from the first object 66 in any suitable manner, in one embodiment the valve is fluidly connected between the vacuum generator 24 and the opening 50 of the base plate 30, as shown herein. The valve 202 also fluidly communicates with the air source 65 (FIG. 1) to detect when the flow of air supplied to the vacuum generator 24 falls below a predetermined minimum operational flowrate. For example, in one embodiment the valve 202 and the vacuum generator 24 each receive a portion of the air from the air source 65. Furthermore, in the embodiment the back-up valve 202 is biased to the closed position (e.g., using a biasing mechanism, not shown, such as a spring) and the valve is driven toward the open position by the air flow received by the back-up valve against the bias of the biasing mechanism. Specifically, the biasing mechanism is selected to be overcome by a predetermined flowrate, thereby moving the valve 202 to the open position when the air flow supplied to the back-up valve falls below the predetermined flowrate. Of course, the predetermined flowrate at which the biasing mechanism is overcome and the valve 202 is closed may or may not be equal to the predetermined flowrate supplied to the vacuum generator 24 at which the valve is selectably positioned in the closed position, depending upon whether the portions of flow supplied to the vacuum generator and the back-up valve are equal. In one embodiment, the predetermined flowrate at which the biasing mechanism is overcome and the valve closed and/or the predetermined flowrate supplied to the vacuum generator 24 at which the valve is selectably positioned in the closed position are adjustable using a processor (not shown) operatively connected to the clamp 200. For example, the biasing mechanism may be adjustable by a processor.

In alternative embodiment, a processor (not shown) may be operatively connected to the back-up valve 202 for controlling operation of the valve, and more specifically for selectably positioning the valve in the open and closed positions. The processor may also detect when the air flow supplied to the vacuum generator 24 falls below the predetermined flowrate from the air supplied to the valve 202. Alternatively, the back-up valve 202 may not be fluidly connected to the air source but may instead receive an electric signal from another processor or device (e.g., a measurement device for measuring the flow of air supplied to the generator 24).

In one embodiment, the clamp 200 includes a vacuum accumulation chamber 204 operatively connected between the back-up valve 202 and the opening 50 of the base plate 30. The vacuum accumulation chamber 204 effectively increases a volume that must reach equilibrium with the area outside the cavity 66 before the seal 28 will detach from the first object 68. Although any suitably sized accumulation chamber may be used without departing from the scope of the present invention, in one embodiment the chamber 204 increases the volume between about one and about ten cubic inches. Although other accumulation chambers may be used without departing from the scope of the present invention, in one embodiment the chamber 204 is a Model MAT-2.0 available from Clippard Instrument Laboratory, Inc. of Cincinnati, Ohio.

In one embodiment, the back-up valve 202 includes an external input 206 for selectively positioning the valve in the open position against the bias. Accordingly, the clamp 200 can be removed manually when the flow of air supplied to the vacuum generator 24 and/or the valve 202 is below a predetermined flowrate.

Although the clamp 200 may remain attached to the first object 68 for any amount of time without departing from the scope of the present invention, in one embodiment the clamp 200 will stay attached to the first object for between about 30 and about 120 minutes after the flow of air supplied to the generator 24 and/or the valve 202 falls below a predetermined flowrate. Moreover, and although the clamp 200 may remain attached to the first object 68 for any amount of time without departing from the scope of the present invention, in one embodiment the clamp 200 will stay attached to the first object for between about 1 and about 20 minutes after the flow of air supplied to the generator 24 and/or the valve 202 falls below a predetermined flowrate and when a moment arm of between about 30 inch pounds and about 150 inch pounds is applied to the clamp.

To facilitate attachment of the clamp 200 using the vacuum generator 24 and/or the back-up valve 202, components of the clamp 200 and the first and/or second objects may be cleaned to enhance the seal between the seal 28 and the object.

Any predetermined flowrate(s) discussed herein may vary depending on the dimensions, shape, and/or weight of the clamp 200, components thereof, and/or the object(s) without departing from the scope of the present invention.

The above-described back-up valve 202 allows the clamp 200 to remain attached to an object even after a supply of air supplied to the clamp falls below a predetermined flowrate. Accordingly, the back-up valve of the present invention facilitates reducing damage to the clamp and/or the objects.

Exemplary embodiments of clamps, valves, and methods for facilitating prevention of detachment of a clamp from an object using the valve are described above in detail. The clamps, valves, and methods are not limited to the specific embodiments described herein, but rather, components of each clamp and/or valve may be utilized independently and separately from other components described herein, and steps of each method may be utilized independently and separately from other steps described herein. Each clamp and/or valve component can also be used in combination with other clamp and/or valve components. Additionally, each method step can also be used in combination with other methods steps.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A clamp for clamping a plurality of objects together, said clamp comprising:

a vacuum base having a seal adapted to engage a first object of the plurality of objects, a cavity defined between the first object and the seal when the seal is engaged with the first object;

a vacuum generator fluidly connected to the cavity for reducing a pressure in the cavity so the pressure inside the cavity is lower than a pressure outside the cavity thereby to attach the vacuum base to the first object;

a clamping member mounted on the vacuum base for engaging a second object of the plurality of objects, said clamping member being movable with respect to the vacuum base for applying a force to the second object to clamp the second object in position relative to the first object when the vacuum base is attached to the first object; and a valve fluidly connected between the cavity and the vacuum generator, said valve being selectably positionable between an open position allowing fluid communication between the vacuum generator and the cavity for generating a pressure inside the cavity that is lower than a pressure outside the cavity, and a closed position at least partially restricting fluid communication between the vacuum generator and the cavity for at least partially preventing air from entering the cavity when pressure inside the cavity reaches a predetermined maximum.

2. A clamp in accordance with claim 1 wherein the valve is biased toward the closed position.

3. A clamp in accordance with claim 2 wherein:

the vacuum generator is driven by fluid from a fluid source;

the valve is fluidly connected to the fluid source;

the valve and the vacuum generator each receive fluid from the fluid source;

the valve is positioned in the open position by fluid received from the fluid source; and said valve closes when fluid received from the fluid source falls below a predetermined flowrate.

4. A clamp in accordance with claim 2 wherein the valve receives an external input for selectably positioning the valve in the open position against the bias.

5. A clamp in accordance with claim 1 further comprising a vacuum accumulation chamber fluidly connected between the valve and the cavity.

6. A clamp in accordance with claim 1 wherein the seal comprises neoprene.

7. A clamp in accordance with claim 1 wherein the vacuum generator is driven by fluid from a fluid source and the clamp comprises a control valve fluidly connected between the vacuum generator and the fluid source for controlling fluid flow supplied to the vacuum generator.

8. A clamp in accordance with claim 1 further comprising a clamping block mounted on the vacuum base, said clamping member being mounted on the clamping block and being movable with respect thereto for positioning an end of the member for engagement with the second object of the plurality of objects, said clamping block and said clamping member being movable with respect to the vacuum base for applying a force to the second object to clamp the first and second objects together when the vacuum base is attached to the first object.

9. A clamp in accordance with claim 1 wherein the clamping member is a first clamping member and the clamp further comprises a second clamping member mounted on the vacuum base for engaging the first object of the plurality of objects.

10. A clamp in accordance with claim 1 wherein the clamping member is pivotally mounted on the vacuum base.

11. A clamp in accordance with claim 1 wherein the vacuum generator comprises a venturi for generating a pressure within the cavity that is lower than a pressure outside the cavity using the fluid flow supplied to the vacuum generator.

12. A method for preventing a clamp from being detached from an object, the clamp including a seal adapted to engage the object and define a cavity between the object and the seal, a vacuum generator fluidly connected to the cavity and a fluid source for generating a pressure inside the cavity that is lower than a pressure outside the cavity, and a valve fluidly connected between the vacuum generator and the fluid source, said method comprising:

allowing fluid communication between the vacuum generator and the cavity when the fluid flow received by the vacuum generator is above a predetermined flowrate; and at least partially preventing fluid from entering the cavity when the fluid flow received by the vacuum generator falls below a predetermined flowrate.

13. A method in accordance with claim 12 further comprising biasing the valve to the closed position.

14. A method in accordance with claim 13 wherein allowing fluid communication between the vacuum generator and the cavity comprises positioning the valve in an open position, and at least partially preventing fluid from entering the cavity comprises positioning the valve in a closed position.

15. A method in accordance with claim 12 enlarging an effective size of the cavity using a vacuum accumulation chamber fluidly connected between the valve and the cavity.

* * * * *